United States Patent [19]

Rosenberger

[11] Patent Number: 5,022,338

[45] Date of Patent: Jun. 11, 1991

[54] CONFIGURABLE WIND POWERED VESSEL

[76] Inventor: John R. Rosenberger, 133 Hayes Place, Centerport, N.Y.

[21] Appl. No.: 137,930

[22] Filed: Dec. 28, 1987

Related U.S. Application Data

[63] Continuation-in-part of Ser. No. 15,911, Feb. 18, 1987, Pat. No. 4,757,777.

[51] Int. Cl.[5] ..... B63B 1/14
[52] U.S. Cl. ..... 114/39.10; 114/61
[58] Field of Search ..... 114/39.1, 61, 345, 272, 114/273, 279, 90

[56] References Cited

U.S. PATENT DOCUMENTS

| | | | |
|---|---|---|---|
| 2,519,230 | 8/1950 | Crankshaw | 114/90 |
| 3,104,642 | 9/1963 | Piazza | 114/279 |
| 3,304,898 | 2/1967 | Sainte-Claire | 114/39.1 |
| 3,831,539 | 8/1974 | Black | 114/39.1 |
| 4,044,702 | 8/1977 | Jamieson | 114/90 X |
| 4,708,075 | 11/1987 | des Snead | 114/39.1 |

OTHER PUBLICATIONS

"Two Hulls and a Sail . . . That's Speed" Science Illustrated, Aug. 1946, pp. 68–69.

*Primary Examiner*—Sherman Basinger

[57] ABSTRACT

Four spars project downward and outward from a common juncture; a mast projects upward from the same juncture. Adjustable cables interconnect all the distal ends to each other. Thus a uniquely strong and light pentahedral-shaped space frame is provided. A unique system for cable length adjustment makes it practical to reconfigure the geometry of the vessel while underway. The vessel can be made tall and narrow for easier maneuvering, in light winds, or broad and low for maximum capsize resistance. Two hulls provide a suitable low speed displacement shape. When sufficient propulsion force is present, however, these two hulls can be split into four hulls, each of a planing shape and each connected to a spar. The wind drag, that is noramlly associated with frames of this nature, is transformed into useful forces by airfoil-shaped spars which are rotatable. These forces may be used to produce a downward push to prevent heeling over, a lift to reduce hydrodynamic drag, and a propulsive push.

12 Claims, 3 Drawing Sheets

CONFIGURABLE WIND POWERED VESSEL

This invention is a continuation-in-part of application Ser. No. 07/015,911 filed on Feb. 18, 1987, now U.S. Pat. No. 4,757,777.

BACKGROUND OF THE INVENTION

The present invention relates to marine vessels, particularly to sailing vessels, and also relates to hull assemblies and structures for sailing vessels.

There are two distinctly different ways that a moving vessel is supported by the water. When a vessel is moving slowly, the forces that are caused by moving water bending around the vessel, are small, and the hulls are supported by buoyant forces.

The hulls which present the least drag for a given weight, when moving slowly are smoothly rounded on both ends. Such hulls are called displacement hulls. When displacement hulls move at significant speed, their rounded ends behave like inverted airplane wings. That is, water flowing around the curved ends of the hull creates a partial vacuum. This vacuum pulls the rounded stern deeper into the water, making the water curve further, thereby increasing drag.

As a result of this phenomenon, displacement hulls exhibit a maximum hull speed. For practical purposes this maximum hull speed is equal to 1.4 times the square root of the hull's length. In lieu of this principle of mechanics, longer and narrower displacement hulls will generally experience less drag and a faster maximum speed.

Hulls which have a relatively large substantially flat surface that is almost parallel to the surface of the water, and are also squared at the aft edge, are called planing hulls. Planing hulls will exhibit far greater drag at very low speeds; however, at higher speeds they do not experience a very significant increase in drag. Indeed, they plane over the surface of the water and will go as fast as their motive force propels them. The practical upper speed limit for planing hulls is reached when waves cause the vessel to jump out of the water, far enough that the vessel fails to come down safely.

A practical sailboat hull must move efficiently in situations wherein the wind only provides enough motive force for low speed displacement motion. For this reason, the vast majority of sailboat hulls are purely displacement designs. There are few practical single hull boats that can plane in a very strong wind, and, there are no known planing multihulled sailboats.

Heretofore displacement boats have been provided with multiple, spaced-apart hulls or pontoons. The common catamaran and the trimaran are typical examples of this approach. Various proposals have been advanced to employ tetrahedral space frames in the construction of multihulled sailboats. These tetrahedral space frames include three elongated spars and an elongated mast extending outwardly from a central juncture. The mast extends upwardly from the central juncture, whereas the spars project outwardly and downwardly from the juncture. Additional bracing elements interconnect the ends of the spars and mast remote from the juncture. These additional bracing elements extend generally along the edges of the tetrahedron. These bracing elements cooperate with the mast spars and other elements to provide a rigid space frame. Pontoons are attached to the spar ends at the lowermost vertices of the tetrahedron.

Tetrahedral space frame structures of this general nature are disclosed, for example, in U.S. Pat. Nos. 3,831,539; 3,991,694; 4,333,412; 4,316,424; and 4,524,709. Because the tetrahedral spaceframe is supported at widely spaced points on the water surface, it has very good stability in the rough seas, and extraordinary resistance to heeling moments. The basic nature of the tetrahedral space frame provides far superior strength for a given weight. Therefore it can be bigger and can carry more sail at a given weight in a given wind, than conventional designs.

While several embodiments of tetrahedral spaceframe boats promise to find extensive utilization; there are disadvantages that are inherent in their basic geometry. The pontoons or hulls must be short, relative to the vessel's over all length, unless further structural elements are added. The addition of these elements add to the weight cost and complexity of the vessel. Also, the spars and mast cause significant wind drag.

SUMMARY OF THE INVENTION

The present invention provides vessels which address those needs.

One preferred embodiment of the present invention provides a vessel having a pentahedral space frame that includes a mast and four struts. In particular, the configuration includes an elongated port aft strut, an elongated starboard aft strut, an elongated port forward strut, an elongated starboard forward strut, and an elongated mast, each having a juncture end and a distal end. Connecting means are provided for attaching the juncture ends of the mast and struts to one another to form a common juncture; so that the struts project outwardly and downwardly from the juncture, and the mast projects upwardly from the juncture. Thus, the distal ends of the struts and mast define the vertices of a pentahedron. The frame also includes stay means, such as cables, to interconnect the distal end regions of the mast and struts, each to each of the others. Thus is provided an exceptionally stable, light, strong, and large frame that is shorter and narrower than an equivalently stable tetrahedral space frame.

The vessel also includes a port pontoon and a starboard pontoon. Pontoon connecting means are provided; for connecting the port pontoon to the distal end regions of both of the port struts, and for connecting the starboard pontoon to the distal end regions of both starboard struts; so that the pontoons will support the frame on the water surface. Propulsion means are provided for moving the vessel along the surface. In this preferred embodiment, the propulsion means include attaching a sail to the mast or another portion of the frame.

A vessel according to this embodiment of the invention includes elongated, rotatable airfoil shaped sleeves that wrap around one or more of the spars and/or the mast. Wind flowing around these airfoil(s) provides the vessel with a large controllable force that is substantially perpendicular to the surface of the airfoil. As the wind's speed and the vessel's course require; this force may be used to apply lift to the vessel's leeward side, a downward push to the vessel's windward side and/or to push the vessel forward.

In the present invention there is also provision to adjust the length of the stays so that the vessel can have greater beam and less height for greater stability. Alternatively it can have greater height and lesser beam for easier maneuvering, and for catching more air when the wind is light.

Provision is also included to split the hulls along a plane that is perpendicular to the vessel's motion, thereby providing four shorter hulls, each hull being connected to a spar. This configuration is particularly desireable when the shape of the hulls and the vessel's speed permit planing motion across the surface of the water. This aspect of the present invention provides the long narrow shape that is important for displacement sailing speeds. When wind conditions permit higher speeds, the vessel can be transformed into a planning design.

A further aspect of the present invention provides means to adjust the length of the stays so that the port hull(s) may be positioned forward of, or aftward of the other hull(s) and so that wave making resistance can be caused to cancel partially. It has been discovered that one hull of a multihull can be made to surf on the wake of another hull with significant reduction in hydrodynamic drag.

FIGS. *2a* through *2d* show various hull configurations of vessel 10, and the wave making patterns that they produce.

Figure 1:
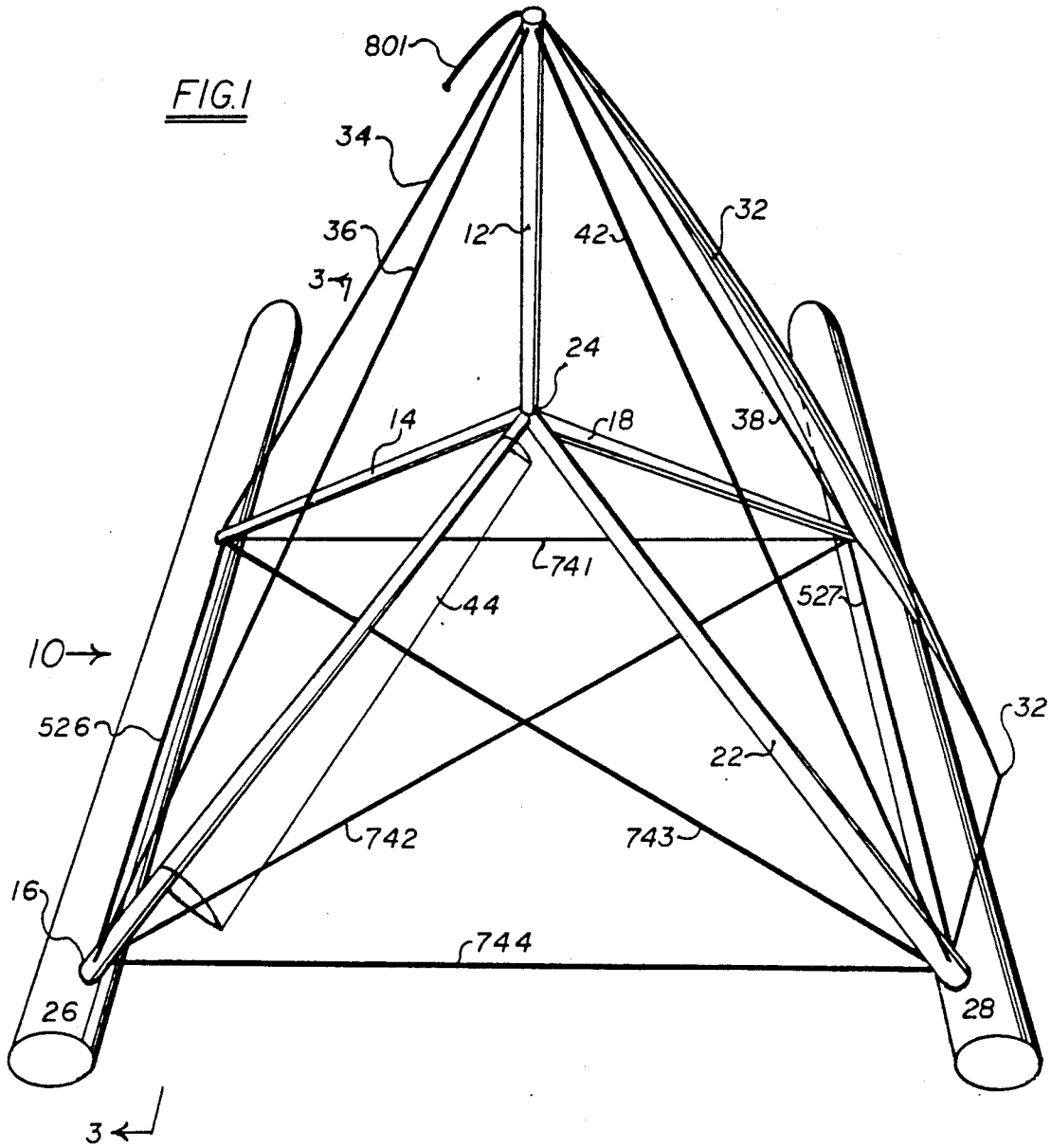
FIG. 1 is a perspective view form showing a sailing vessel embodying the principles of this invention; sail 32 and sleeve 44 are shown in phantom.

FIG. *3a* is a view along 3—3 of FIG. 1 showing a side view of pontoon 26.

FIG. *3b* is the pontoon of FIG. *3b* split.

FIG. *4a* is a view along 3—3 of FIG. 1, showing a side view of an alternative pontoon configured for planing movement. Airbag 65 is deflated.

FIG. *4b* shows the pontoon of FIG. *4a* configured displacement movement. Airbag 65 is inflated.

FIG. *4c* shows the pontoon of FIG. *4a* configured for displacement movement. Alternative airbag 650 is shown in phantom view.

Figure 5:
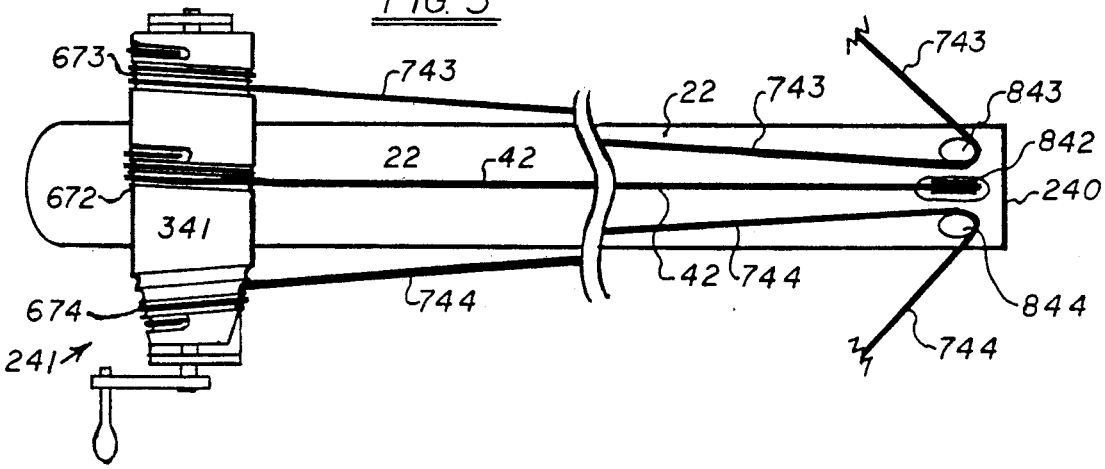

FIG. 5 is a detail view of spar 22 and a preferred embodiment of the stay length adjustment invention.

DETAILED DESCRIPTION OF THE PREFERRED EMBODIMENTS

Referring to FIG. 1 there is illustrated a sailing vessel 10 of pentahedral design comprising a vertically extending mast 12, a port forward spar 14, a port aft spar 16, a starboard forward spar 18 and a starboard aft spar 22. The proximal ends of spars 14 to 22 and mast 12 are joined in a common juncture 24.

The distal ends of spars 14 and 16 are connected to a pontoon 26 that is parallel to a pontoon 28. Pontoon 28 is connected to the distal ends of spars 18 and 22. Cables 34, 36, 38, and 42 connect the distal end of mast 12 to the distal ends of spars 14, 16, 18, and 22, respectively, to provide support and rigidity to the structure. Beamwise cables 741 and 744 connect the distal ends of spars 14, 16, 18, and 22. Cables 742 and 743 cross connect the distal ends of spars 14, 16, 18, and 22. These cables reduce the stresses on the structure in certain critical loading conditions but are not essential to the structure. Cable 801 extends from atop mast 12 to provide hoisting means. Sail 32 is attached to the top of mast 12 and to pontoon 28. The cables may be adjustable in length in order to alter the geometry of vessel 10.

Spar 16 and/or any of the remaining spars 14 through 22 is provided with an airfoil shape sleeve 44, shown in phantom, mounted on strut 16. A sailor can rotate sleeve 44 about the axis of elongation of spar 16 to any desired angle. In having an airfoil shape and being in the wind, a force is produced that is substantially perpendicular to the surface of sleeve 44. By rotating sleeve 44 the sailor can rotate the direction of this force to almost any direction that is desired.

Figure 3A:
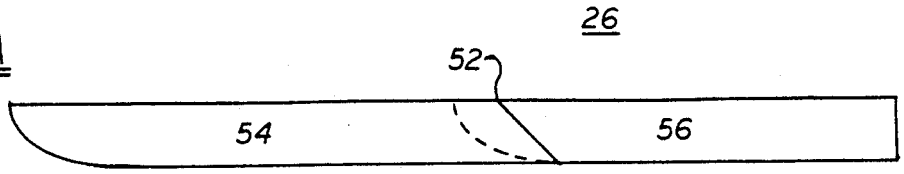
Figure 3B:
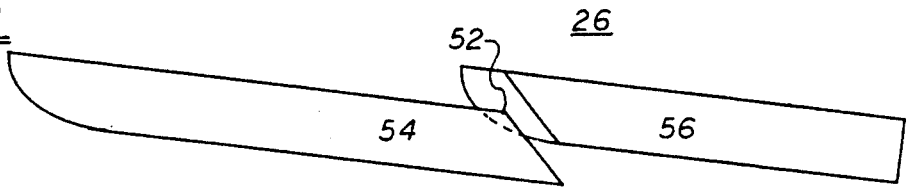

Pontoons 26 and 28 may be split amidships so they can be separated into four shorter planning hulls. This may be accomplished as shown in FIGS. 3A and 3B where pontoon 26 is composed of hull blocks 54 and 56, which can be separated at 52 thereby forming a pair of shorter hulls as illustrated in FIG. *3b*. When a hull is separated, it is essential that the distal ends of those spars which are attached to the hull remain the same distance apart. This is best accomplished by means of cable 526 (shown in FIG. 1) which connects the distal end of spar 16 to the distal end of spar 14. Also shown in FIG. 1 is cable 527 which similarly interconnects the distal ends of spars 18 and 22.

Figure 2A:
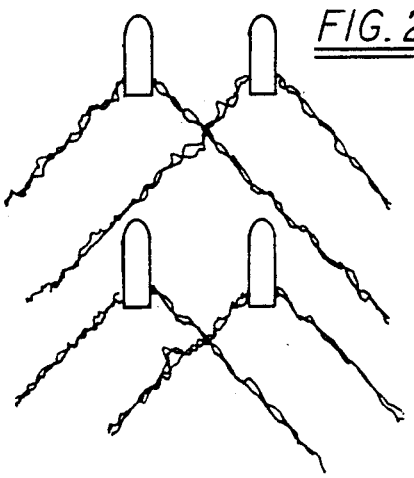
Figure 2B:
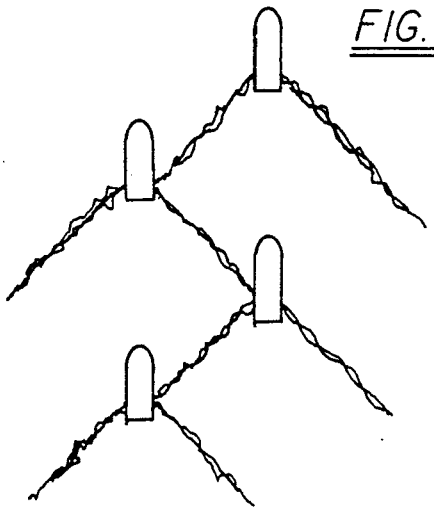
Figure 2C:
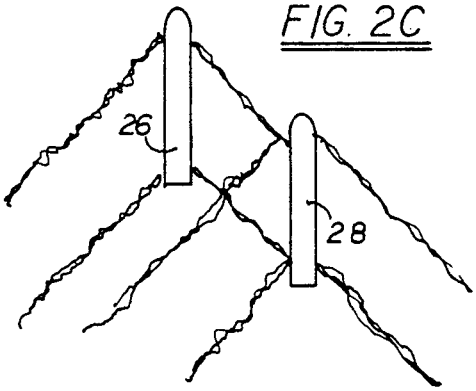
Figure 2D:
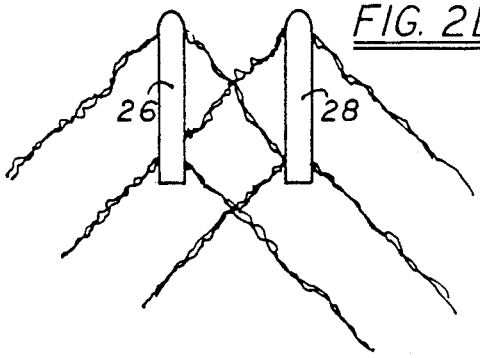

FIGS. 2A and 2B serve to illustrate how the wave pattern of a four hulled vessel may be controlled by altering the geometric relationship of its hulls. For purposes of clarity only the stern waves are shown in FIGS. 2A and 2B. FIG. 2C shows a hull configuration and a wave pattern that has been observed to experience less drag than the conventional hull configuration and wave pattern shown in FIG. 2D.

Figure 4B:
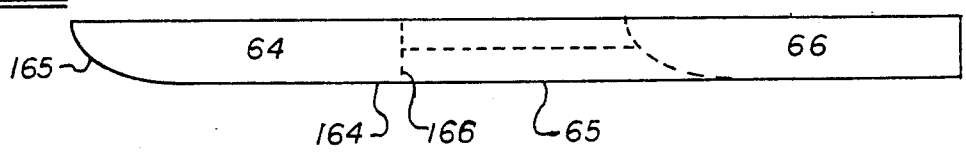
Figure 4A:
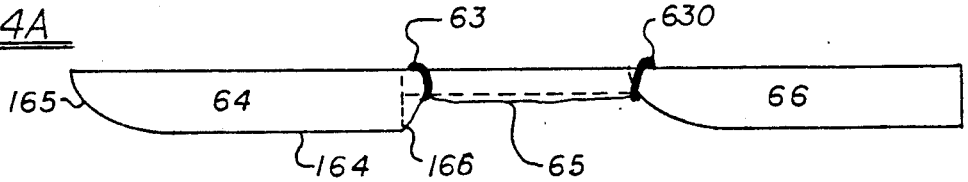

FIG. 4A is a view along 3—3 of FIG. 1 showing a side view of an alternative pontoon configured for planing movement. Forward pontoon 64 has flat bottom 164, an upward curving prow 165 and a squared stern 166. Airbag 65 is deflated and held out of the water by lifting loops 63 and 630.

Forward pontoon 64 and aft pontoon 66 are connected to an elongated rigid mid-section (unnumbered).

FIG. 4B shows the pontoon of FIG. 4A, configured for displacement movement. Airbag 65 is inflated and an elongated smooth shape is provided that is most desireable for displacement sailing.

Figure 4C:
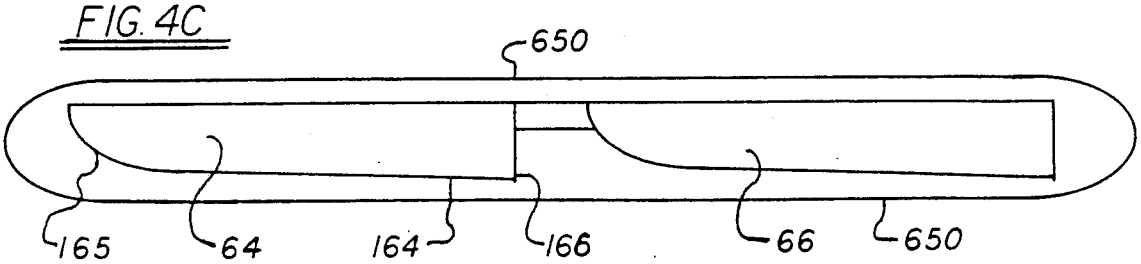

FIG. 4C shows the pontoon of FIG. 4A, configured for displacement movement. Alternative airbag 650 (shown in phantom view) encloses and extends beyond hulls 64 and 66, thereby providing a smooth displacement shape.

FIG. 5 is a shortened detail view of spar 22. Cables 42, 743, and 744 intersect spar 22 near distal end 240. They pass through a hooking means such as pulleys 842, 843 and 844 and run parallel to spar 22 into winch 241 that is mounted proximal to juncture 24 (not shown). Winch 241 has drum 341. Drum 341 has three sets of grooves 672, 673, and 674. Cables 42 and 743 pass over drum 341 whereas cable 744 passes under drum 341. Therefore, rotating the drum in one direction will take in cables 42 and 743 while simultaneously paying out cable 744. Grooves 672, 673, and 674 are cut to varying diameters to insure that the right amount of cable is paid out with each degree of revolution of drum 341. It should be appreciated that the cables that connect the other spars and/or mast can similarly be connected to drum 341. By means of appropriate diameter grooves almost any alterations of the geometry of the spars and mast may be accomplished.

One particularly desireable programming is achieved when all the cables are connected to drum 341. When drum 341 is rotated in one direction, the cables that connect to the mast are taken in, and the cables which run beamwise are paid out, and the vessel becomes simultaneously shorter and wider. Thus the vessel is better configured for strong wind conditions. Similarly, rotating the drum in the opposite direction raises and narrows the vessel for better maneuvering and low wind conditions.

It is thus seen there has been provided a unique sailing vessel with increased capability of speed, control, and greater strength for a given weight. While only certain preferred embodiments of this invention have been described, it is understood that many variations of this invention are possible without departing from the principles of this invention as set forth in the claims that follow.

What is claimed is:

1. A high strength waterborne sailing vessel comprising:

(a) an elongated port aft spar, an elongated starboard aft spar, an elongated forward port spar, an elongated forward starboard spar, and an elongated mast, each of said spars and said mast having a juncture end, a distal end, and a distal end region adjacent the distal end, a connecting means for attaching the juncture ends of the spars to one another to form a common juncture so that said spars project outwardly and downwardly from said juncture, so that the ends of said spars define the vertices of a pyramid, said mast projects upwardly from said juncture, and the distal ends of said spars and mast define the vertices of a pyramid; and (b) a stay means for connecting the distal end region of said mast to the distal end regions of each of said spars; and (c) a starboard stay means for connecting the distal end regions of the starboard spars to each other; and (d) a port stay means for connecting the distal end regions of the port spars to each other; and (e) a stay means for connecting the distal end regions of the forward spars to each other; and (f) a stay means connecting the distal end regions of the aft spars to each other; and (g) a water support means for supporting the vessel proximal to the surface of the water; and (h) a propulsion means for propelling the vessel along the surface of the water.

2. A vessel as claimed in claim 1, wherein said water support means, and said port stay means, and said starboard stay means comprises:

(a) an elongated port and an elongated starboard pontoon, and (b) pontoon connecting means for connecting said port pontoon to both of said port spars, and (c) pontoon connecting means for connecting said starboard pontoon to both of said starboard spars.

3. A vessel as claimed in claim 1, wherein said water support means comprises a forward port pontoon, an aft port pontoon, a forward starboard pontoon, an aft starboard pontoon, and pontoon connecting means for connecting said pontoons to the distal end regions of the corresponding spars, each spar being connected to one pontoon, and each pontoon being connected to one spar.

4. A vessel as claimed in claim 3, further comprising a hull joining means, for connecting the starboard pontoons together and/or the port pontoons together in a smoothly fitting manner, whereby the joined pontoons present an elongated smooth displacement shape.

5. A vessel as claimed in claim 4, wherein said hull joining means comprises a stern shape on the forward pontoon(s) which is flat or concave and shaped to mate with the prow of the aft pontoon to form a smooth displacement shape.

6. A vessel as claimed in claim 4, wherein said joining means comprises a substantially flexible airbag enclosing the forward and aft pontoons, and further comprising an airbag lifting means, whereby when said airbag is inflated and said lifting means is relaxed an elongated smooth shape is provided which contains the forward and the aft pontoons, and whereby when said airbag is deflated and said lifting means is operative the planing surfaces of said pontoons are exposed to provide planing motion across the water.

7. A vessel as claimed in claim 4, wherein said hull joining means comprises a substantially flexible airbag which is connected to the forward pontoon and connected to the aft pontoon, and further comprising an airbag lifting means; whereby when said airbag is inflated and said lifting means is inopperative an elongated substantially smooth shape is provided which incorporates the forward pontoon, the airbag, and the aft pontoons; and whereby when said airbag is deflated and said lifting means is operative to lift part of said airbag above the water, the planing surface of said pontoons are exposed to provide planing motion across the water.

8. A vessel as claimed in claim 1, further comprising one or more stay length adjustment means, each of said stay length adjustment means comprising a winch, a plurality of the stay means being attached to the drum of said winch, wherein, the length of a plurality of the stay means may be simultaneously adjusted, and whereby the geometric relationship of the distal ends relative to each other may be modified.

9. A vessel as claimed in claim 8, wherein said drum has multiple grooves of predetermined diameters, each groove being configured to accept one or more stay means, the ends of said stay means being fixed to said drum, so that when said drum is rotated, said predetermined diameters provide that the right amount of stay means distance is simultaniously payed out and/or taken in, so that the vessel is kept in reasonable tension while the geometric relationship of said distal ends relative to each other is adjusted.

10. A vessel as claimed in claim 1, further comprising a hoisting means which is attached to the distal end of said mast.

11. A waterborne vessel comprising;

(a) a forward buoyant pontoon having an upward curving prow a substantially flat bottom and a square stern suitable for planing; and (b) an elongated rigid mid section; and means for connecting said forward pontoon to said mid section; and (c) an aft pontoon, and means for connecting said pontoon to said mid section; and (d) an airbag which is attached to said forward pontoon and said aft pontoon, wherein when said airbag is inflated, an elongated substantially smooth shaped displacement hull is provided which incorporporates the forward pontoon, the airbag, and the aft pontoon; and (e) a means for lifting the portion of said air bag which is proximal to said forward pontoon out of the water when said airbag is deflated, thereby providing a planing surface for high speed movement; and (f) a means for propelling said vessel along the surface of the water.

12. A sail system for tetrahedral space frame and pentahedral space frame vessels, these vessels having a plurality of spars, comprising: at least two elongated airfoil shaped sleeves, each of said sleeves being wrapped around one of said spars, each said sleeve being rotatable with respect to said frame about an axis which is substantially parallel to the axis of elongation of said spar which said sleeve is wrapped around, said sleeves being rotatable such that the angle of said sleeves relative to the wind is set to apply opposite stabilizing forces to said vessel through said sleeves.

* * * * *